United States Patent [19]

Krisel

[11] 4,381,618

[45] May 3, 1983

[54] TOY FLAT ARTICLE CONSTRUCTION SET

[75] Inventor: Elisabeth Krisel, East Aurora, N.Y.

[73] Assignee: The Quaker Oats Company, Chicago, Ill.

[21] Appl. No.: 226,065

[22] Filed: Jan. 19, 1981

[51] Int. Cl.[3] ..... A63H 33/12

[52] U.S. Cl. ..... 46/22; 428/316.6

[58] Field of Search ..... 46/16, 22, 25, 26, 31, 46/151, 157, 156; 2/68; 36/4, 8.1; 273/DIG. 2, DIG. 8; 428/316.6, 71

[56] References Cited

U.S. PATENT DOCUMENTS

| | | | |
|---|---|---|---|
| 1,769,328 | 7/1930 | Auster | 36/4 X |
| 1,931,486 | 10/1933 | Casey | 2/68 |
| 2,450,326 | 9/1948 | Berger et al. | 46/22 |
| 2,644,280 | 7/1953 | O'Neil | 428/316.6 X |
| 2,878,153 | 3/1959 | Hackländer | 428/316.6 X |
| 3,047,888 | 8/1962 | Schecter et al. | 428/316.6 X |
| 3,389,195 | 6/1968 | Gianakos et al. | 264/45 |
| 3,419,993 | 1/1969 | Rodgers | 46/31 X |
| 4,083,742 | 4/1978 | Sugimoto | 46/157 X |

*Primary Examiner*—F. Barry Shay

*Attorney, Agent, or Firm*—Cumpston & Shaw

[57] ABSTRACT

A plurality of flat, flexible and stretchable articles of different peripheral shapes are provided, each having one or more openings extending therethrough. A plurality of double-headed buttons are provided in which one of the heads of each button is insertable through aligned openings in two or more of the articles for releasably securing the articles together to form a fanciful creation. The flat articles are comprised of upper and lower stretchable fabric layers with a resilient foam material sandwiched therebetween.

4 Claims, 3 Drawing Figures

TOY FLAT ARTICLE CONSTRUCTION SET

BACKGROUND OF THE INVENTION

1. Field of the Invention

The present invention relates generally to toy construction sets, and more particularly to a flat article construction set for making fanciful creations.

2. Description of the Prior Art

Construction sets comprising metal or wood parts of various shapes which can be assembled to form fanciful creations are well known in the art. In one known set, flat metal stampings having openings extending therethrough are secured together by nuts and bolts. In another known construction set, cylindrical rods are provided in which the ends thereof are insertable into blind, radially extending bores in circular joining members.

SUMMARY OF THE INVENTION

It is a primary object of the present invention to provide a novel flat article construction set in which the flat articles are assembled together by buttons to form fanciful creations.

Briefly, the presently preferred embodiment of the invention comprises a plurality of flat, flexible and stretchable articles of different peripheral shapes. The articles are releasably secured together by double-headed buttons, one head of which is insertable through openings in the articles to form fanciful creations.

In another aspect of the invention, each article comprises a layer of resilient plastic foam material sandwiched between and secured to layers of fabric, all of which have the same peripheral shape.

In still another aspect of the invention, each button comprises a cylindrical shank having a circular disk-like head at each end thereof.

One advantage, for example, of the flat article construction set of this invention is that the parts thereof can be easily assembled and disassembled.

Another advantage of this set is its high safety for children due to the flexibility of the articles. Injury to any child struck by an article is minimized.

Still another advantage of the flat article construction set of this invention is that the colorful fabric articles and creations formed therefrom are highly pleasing and stimulating to children.

The invention and its advantages will become more apparent from the detailed description of the invention presented below.

BRIEF DESCRIPTION OF THE DRAWING

The details of this invention will be described in connection wtih the accompanying drawing, in which.

DETAILED DESCRIPTION OF THE INVENTION

Figure 1:
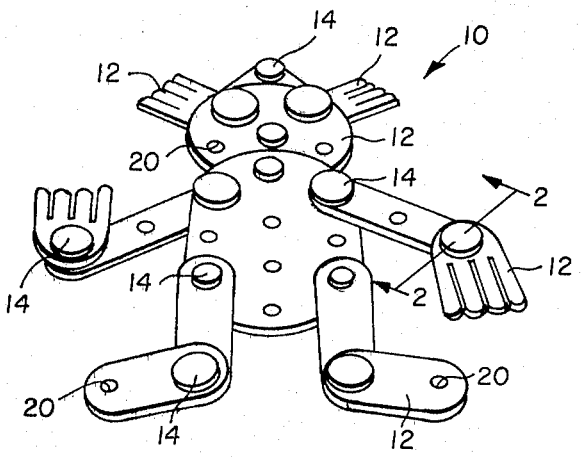
FIG. 1 is a top perspective view of a creation formed from the flat article construction set of this invention.

Referring to FIG. 1 of the drawing, one examplary creation 10 is shown formed from the flat article construction set of this invention. It should be understood, of course, that a large number of different creations can be constructed by this set, the number being limited in large part by the creativity and imagination of the children using the set.

Figure 3:
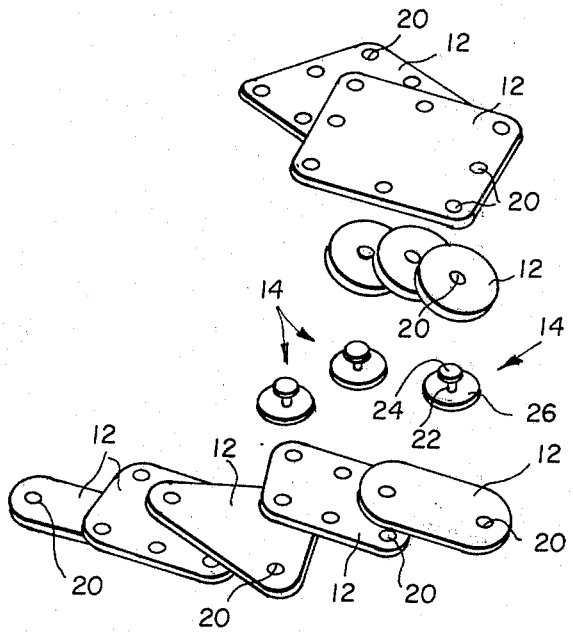
FIG. 3 is a top perspective view of some of the articles and buttons comprising the construction set.
Figure 2:
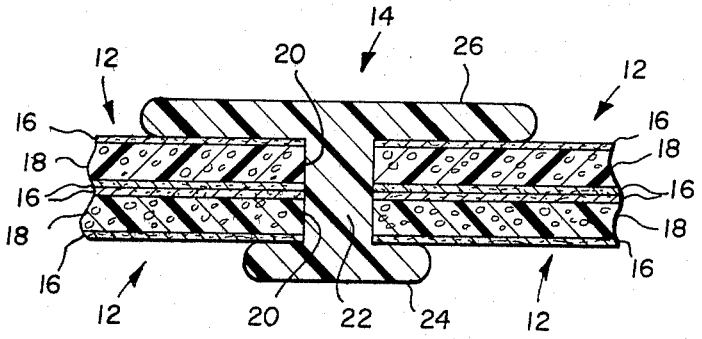
FIG. 2 is a section view taken substantially along line 2—2 of FIG. 1.

With reference to FIGS. 1-3, each creation 10 is formed from a plurality of flat articles 12 secured together by buttons 14. Each article 12 comprises upper and lower stretchable fabric layers 16 between which is securely sandwiched, by any suitable means such as cement, heat or the like, a layer 18 of resilient material formed, for example, from any suitable plastic foam material. All of the layers 16, 18 of each article have the same outer peripheral shape, and such shape is highly variable as shown in FIG. 3. The articles 12 may be formed from a solid sheet of fabric and foam material fed through a stamping or cutting device having endless cutting blades of varied shapes, such as circular, square, rectangular, triangular, oblong or the like. Each article 12 is further provided with one or more preferably circular openings 20 punched therethrough for a purpose to be explained hereinafter.

The articles 12 are releasably secured together by the double-headed buttons 14 as best seen in FIG. 2. Each button comprises a cylindrical shank 22 of a diameter less than an opening 20, and a length sufficient to accommodate at least two articles. Each shank 22 further has heads 24, 25 at the ends thereof. Head 24 is slightly larger than an opening 20 in an article, and is insertable through the opening when the article material surrounding the opening is stretched for releasably securing the article to the button. Head 26 is considerably larger than an opening 20 and is incapable of being inserted therethrough, thereby providing a back stop for the article(s) 12.

To increase the appealability and attractiveness of the construction set and creations formed thereby to children, the fabrics 16 and buttons 14 are brightly colored red, yellow, blue and green, for example. In addition to stimulating creativity with regard to various shaped creations, color perception, combinations and matching are stimulated.

While a presently preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A toy flat article construction set for making fanciful creations comprising:

a plurality of flat, flexible and stretchable articles of different peripheral shapes, each article comprising an upper and a lower stretchable fabric layer secured to opposite surfaces of an intermediate layer of resilient foam material and having one or more openings extending therethrough; and at least one double-headed button, the heads of said button and the openings being sized such that each head is larger than each opening, at least one of the heads being insertable through each opening by stretching the periphery of the opening, whereby said button is insertable through openings in two or more of said articles for releasably securing said articles together to form a fanciful creation.

2. An article construction set according to claim 1 wherein each of said double-headed buttons is formed from plastic material, and comprises a cylindrical shank having a circular disk-like head at each end thereof.

3. An article construction set according to claim 2 wherein each of said openings is circular, and the diameters of each of said shanks is less than the diameter of an opening.

4. An article construction set according to claim 3 wherein the diameter of one of said heads is larger than the diameter of said opening, but is insertable through said opening due to the flexibility and stretchability of said article, and the diameter of the other of said heads is substantially larger than the diameter of said opening and is not insertable therethrough.

* * * * *